US006302008B1

(12) United States Patent
Lübben et al.

(10) Patent No.: US 6,302,008 B1
(45) Date of Patent: Oct. 16, 2001

(54) PROCESS OF PRODUCING A PROPELLANT CHARGE IGNITER

(75) Inventors: Manfred Lübben, Celle; Stefan Thiesen, Willich; Klaus Unterstein, Düsseldorf, all of (DE)

(73) Assignee: Rheinmetall W&M GmbH, Unterlüss (DE)

( * ) Notice: Subject to any disclaimer, the term of this patent is extended or adjusted under 35 U.S.C. 154(b) by 0 days.

(21) Appl. No.: 09/145,547

(22) Filed: Sep. 2, 1998

(30) Foreign Application Priority Data

Sep. 3, 1997 (DE) ..... 197 38 419

(51) Int. Cl.[7] ..... C06C 7/02; F42B 1/036
(52) U.S. Cl. ..... 86/10; 102/202
(58) Field of Search ..... 86/10, 1.1; 102/202, 102/469, 470; 124/69, 74

(56) References Cited

U.S. PATENT DOCUMENTS

| | | | | |
|---|---|---|---|---|
| 2,424,993 | | 8/1947 | Meister . | |
| 2,446,187 | * | 8/1948 | Meister | 102/202 |
| 3,311,013 | * | 3/1967 | Phipps | 86/20.1 |
| 4,822,649 | | 4/1989 | Canaud et al. . | |
| 5,670,735 | * | 9/1997 | Ortmann et al. | 102/202 |

FOREIGN PATENT DOCUMENTS 1 534 469 A 12/1978 (GB) .

* cited by examiner

*Primary Examiner*—Charles T. Jordan
*Assistant Examiner*—Son T. Nguyen
(74) *Attorney, Agent, or Firm*—Venable; Norman N. Kunitz

(57) ABSTRACT

A process of producing a propellant charge igniter for cartridge ammunition of the type including an ignition tube with a booster charge, wherein the ignition tube is composed of a sheathing tube (4) with ignition openings (3) and a thin-walled protective tube (6) which is arranged inside the sheathing tube (4) in order to protect the booster charge, and wherein the external wall of the protective tube fits against the internal wall of the sheathing tube (4) and covers the ignition openings (3). To avoid microscopic gaps between the sheathing tube and the protective tube, which gaps influence the performance of the propellant charge igniter, a paste-like sealing agent (5) is introduced into the sheathing tube (4) before the protective tube (6) is inserted into the sheathing tube (4), and only then is the protective tube (6) inserted into the sheathing tube (4) to displace the sealing agent. Alternatively with the protective tube (6) being fully inserted, the ignition openings (3) in the sheathing tube (4) are filled with a sealing agent (5) and then the protective tube (6) as well as the sheathing tube (4) are moved axially, relative to each other.

18 Claims, 1 Drawing Sheet

PROCESS OF PRODUCING A PROPELLANT CHARGE IGNITER

REFERENCE TO RELATED APPLICATIONS

This application claims the priority of German Application Ser. No. DE 197 384 19.6 , filed Sep. 3, 1997 which is incorporated herein by reference.

BACKGROUND OF THE INVENTION

The present invention relates to a process of producing a propellant charge igniter for cartridge ammunition which igniter comprises an ignition tube containing a booster charge. More particularly, the present invention relates to a method of producing such a propellant charge igniter wherein the ignition tube is composed of a sheathing tube provided with ignition openings, and a thin-walled protective tube that is arranged inside the sheathing tube to protect the booster charge, which protective tube rests with its external wall against the internal wall of the sheathing tube and covers the ignition openings.

In order to protect the booster charge against external environmental influences (e.g., against moisture entering from the outside) or against components of the propellant powder surrounding the propellant charge igniter, which can come in contact with the booster charge as a result of sweating, migration or plasticizer migration), known propellant charge igniters are provided with a thin-walled protective tube, the outside wall of which fits flush against the inside wall of a sheathing tube provided with ignition openings and covers these openings. Practical tests performed with such propellant charge igniters have shown that microscopic gaps or clearances can occur between the sheathing tube and the protective tube, which gaps or clearances reduce the protective effect.

It is therefore the object of the present invention to provide a process of producing a propellant charge igniter of the type discussed above, which avoids the occurrence of microscopic gaps or clearance.

SUMMARY OF THE INVENTION

The invention according to a first embodiment is essentially based on the idea of filling the sheathing tube on the base side with a predetermined amount of sealing agent which has the consistency of paste during the processing, and to push this sealing agent into the sheathing tube with the aid of the protective tube, which is closed on one end, so that the protective tube can slide into the sheathing tube and seal any possibly existing spaces between the sheathing tube and the protective tube and subsequently harden therein. During the production, the excess sealing agent is pushed out from the inside through the ignition openings, and is then removed on the outside.

According to a second embodiment of the invention, an approximately 15 mm thick coating of sealing agent preferably is applied to the protective tube in the base region of the sheathing tube, and the protective tube, preferably with the coating, is then pushed into the sheathing tube to its limit. The sealing agent then is injected, e.g., with the aid of a cartridge, from the outside, through the individual ignition openings or bores. Possibly existing gaps between the protective tube and the sheathing tube in the region of the ignition openings or bores are closed and the bores are filled. If desired, the sheathing and protective tubes can then be moved axially relative to one another to further distribute the sealing agent.

In the alternative embodiment, possibly existing microscopic gaps or clearances are not filled completely, but only partially. That is, only at those locations where moist and volatile propellant charge components can enter are the gaps filled.

Further details and advantages of the invention follow from the detailed description below of an exemplary embodiment of the invention which is explained with the aid of the drawing figures.

DETAILED DESCRIPTION OF THE PREFERRED EMBODIMENTS

Figure 1:
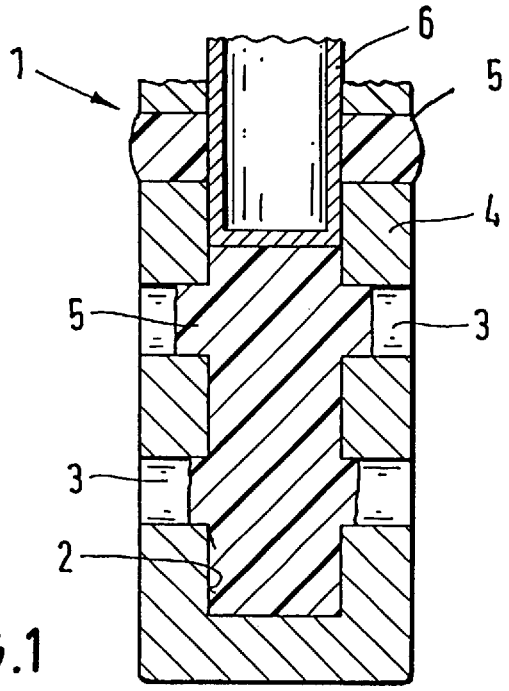
FIG. 1 shows a longitudinal section through a portion of a propellant charge igniter sheathing tube, filled with a paste-like sealing agent, during the insertion of the protective tube made of plastic.
Figure 2:
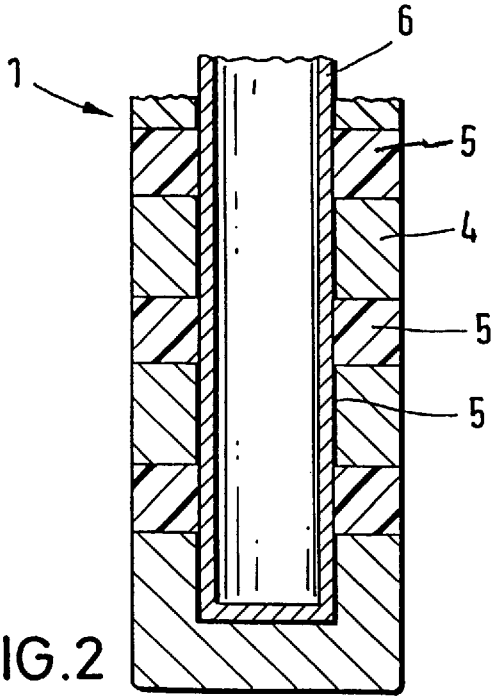
FIG. 2 shows the longitudinal section displayed in FIG. 1 after the protective tube is completely inserted into the sheathing tube.

Referring to FIGS. 1 and 2, there is shown the end region 1 of a sheathing tube 4 of an ignition tube, which tube 4 is closed at one end to define a hollow space 2 and is provided with radially extending ignition openings or bores 3 in its side wall. The hollow space 2 of the sheathing tube 4 is filled with a given amount of paste-like sealing agent 5.

FIG. 1 shows a thin-walled plastic protective tube 6 which is closed at its lower end and which has been pushed, with the aid of a non-depicted plunger or ram, from above partially into the hollow space 2, so that the sealing agent 5 is displaced and moves into the intermediate spaces that may exist between the protective tube 6 and the sheathing tube 4. The excess sealing agent 5 is pushed out through the ignition openings 3, as shown in the uppermost opening in FIG. 1, and is subsequently removed. FIG. 2 shows the protective tube 6 completely inserted into the sheathing tube 4 to displace the sealing agent 5 and fill the openings 3 and with the excess sealing agent 5 removed.

According to a preferred alternate embodiment of the invention, prior to insertion into the sheathing tube 4 and using a process not illustrated in detail here, an approximately 15 mm thick coating of sealing agent 5 preferably is applied to the protective tube 6 on its circumferential surface facing the sheathing tube 4, that is, in the base region 1 of sheathing tube 4. The protective tube 6 is then pushed into the sheathing tube 4 until it reaches its insertion limit, wherein the sealing agent 5 seals the intermediate space between the sheathing tube 4 and the protective tube 6, at least in the base region, and the stripped-off excess sealing agent is removed on the outside. With the aid of a cartridge (not shown), sealing agent 5 is subsequently injected from the outside into the individual ignition or blow-out openings 3, thereby closing off and filling possibly existing gaps between the protective tube 6 and sheathing tube 4 in the region of the blow-out openings 3. Microscopic gaps in particular are not filled completely, but only partially with this process, that is to say only at locations in danger of allowing moisture and volatile propellant components to enter are sealed. If desired, the protective tube 6 and the sheathing tube 5 may then be moved axially relative to one another a number of times to further distribute the sealing agent 5. Finally, the sealing agent is permitted to harden.

Following the hardening of sealing agent 5, the booster charge, which is not shown for reasons of clarity, is inserted into the ignition tube in a manner known per se.

The sealing agents used can be either 2-component polyurethane (PU) adhesives (without solvents) or paste-like, one-component sealing agents, e.g., on a silicone base, wherein the sealing agents must be selected such that they ensure good adhesion to the protective tube 6, which normally is made of plastic, and to the ignition or sheathing tube 4 that is normally composed of metal.

The respective, paste-like sealing agents have the advantage of containing nearly 100% solid matter and are processed with only a small amount of solvents or none at all. The sealing agents have a high creep stability without tendency to flow during the processing and in the hardening phase. The hardening can occur physically through the extraction of small amounts of residual solvent or through diffusion of moisture, which leads to a chemical cross-linking.

Among other things, sealing agents on a polyisobutylene or butyl rubber base have proven themselves. These sealing agents harden physically through the extraction of small amounts of residual solvents, which extraction can be accelerated through heating, preferably by approximately 50° C.

Sealing agents and adhesives on a silicone or polyurethane base, which are preferred, harden through the admittance of moisture or the admixture of a hardening agent component. The hardening of these sealing agents can also be accelerated through heating.

Once they have hardened, the aforementioned sealing agents exhibit a sufficiently high deformability, elasticity and expansion in the temperature range between $-_{54}$° C. and 71° C. to compensate for the thermal behavior of the sheathing tube 4 and protective tube 5 relative to each other.

The invention now fully being described, it will be apparent to one of ordinary skill in the art that many changes and modifications can be made thereto without departing from the spirit or scope of the invention as set forth herein.

What is claimed is:

1. A process of producing a propellant charge igniter for cartridge ammunition of the type comprising an ignition tube with a booster charge, wherein the ignition tube is composed of a sheathing tube closed at one end and provided with radially extending ignition openings, and a thin-walled protective tube that is closed at one end is arranged inside the sheathing tube to protect the booster charge, with the protective tube resting with its closed end against the closed end of the sheathing tube and with its external wall against the internal wall of the sheathing tube and covering the ignition openings; said method including the steps of: placing a paste-like sealing agent inside the sheathing tube before the protective tube is inserted into the sheathing tube, and subsequently inserting the protective tube into the sheathing tube to displace the sealing agent via the openings and seal same.

2. A process according to claim 1, wherein the sealing agent is an adhesive.

3. A process according to claim 1, wherein the sealing agent has at least one of a polyisobutylene base, a butyl rubber base, a silicone base or a polythene base.

4. A process of producing a propellant charge igniter for cartridge ammunition of the type including an ignition tube containing a booster charge, wherein the ignition tube is composed of a sheathing tube closed at one end and provided with radially extending ignition openings, and a thin-walled protective tube that is closed at one end and is arranged inside the sheathing tube to protect the booster charge, with the protective tube resting with its closed end against the closed end of the sheathing tube, and with its external circumferential wall against the internal circumferential wall of the sheathing tube and covering the ignition openings; said method including: inserting the protective tube into the sheathing tube; and subsequently injecting a sealing agent into the ignition openings of the sheathing tube to fill the ignition openings with the sealing agent and such that the sealing agent can penetrate from the ignition openings into a space between the protective tube and the sheathing tube.

5. A process according to claim 4, wherein the sealing agent is an adhesive.

6. A process according to claim 4, wherein the sealing agent has at least one of a polyisobutylene base, a butyl rubber base, a silicone base or a polythene base.

7. A process according to claim 4 further comprising applying a thin layer of the sealing agent to the outer surface of the protective tube prior to insertion of the protective tube into the sheathing tube.

8. A process according to claim 7 further comprising, after said step of injecting, moving the sheathing tube and the protective tube axially relative to one another.

9. A process according to claim 4 further comprising, after said step of injecting, moving the sheathing tube and the protective tube axially relative to one another.

10. A process according to claim 4, wherein the protective tube is formed of plastic.

11. A process according to claim 10, wherein the sheathing tube is made of metal.

12. A process of producing a propellant charge igniter for cartridge ammunition of the type comprising an ignition tube wit a booster charge, wherein the ignition tube is composed of a sheathing tube closed at one end and provided with radially extending ignition openings, and a thin-walled protective tube that is closed at one end is arranged inside the sheathing tube to protect the booster charge, with the protective tube resting with its closed end against the closed end of the sheathing tube and with its external wall against the internal wall of the sheathing tube and covering the ignition openings; said method including the step of: sealing the openings, and any space adjacent to the openings between the internal wall of the sheathing tube and the external wall of the protective tube at least with a sealing agent applied at least one of before insertion of the protective rube into the sheathing tube or subsequent to insertion of the protective tube into the sheathing tube, in that subsequent to inserting the protective tube into the sheathing tube, injecting the sealing agent into the ignition openings of the sheathing tube to fill the ignition openings with the sealing agent and such that the sealing agent penetrates from the ignition openings into a space between the protective tube and the sheathing tube.

13. A process according to claim 12, wherein the sealing agent is an adhesive.

14. A process according to claim 12, wherein the step of scaling includes: placing the sealing agent inside the sheathing tube before the protective tube is inserted into the sheathing tube, and subsequently inserting the protective tube into the sheathing tube to displace the sealing agent via the openings and seal same.

15. A process according to claim 14, wherein the protective tube is formed of plastic and the sheathing tube is made of metal.

16. A process according to claim 12, wherein the protective tube is formed of plastic.

17. A process according to claim 16, wherein the sheathing tube is made of metal.

18. The process according to claim 12, wherein the sealing agent is paste-like.

* * * * *